US007043840B2

(12) United States Patent
Walker, Jr. et al.

(10) Patent No.: US 7,043,840 B2
(45) Date of Patent: May 16, 2006

(54) SHAVING RAZOR AND BLADE UNIT WITH IMPROVED GUARD

(75) Inventors: Vincent P. Walker, Jr., Bridgewater, MA (US); Stephen C. Metcalf, West Newton, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 10/752,115

(22) Filed: Jan. 6, 2004

(65) Prior Publication Data

US 2004/0134072 A1 Jul. 15, 2004

Related U.S. Application Data

(62) Division of application No. 09/515,196, filed on Feb. 29, 2000, now Pat. No. 6,675,479.

(51) Int. Cl.
*B26B 21/40* (2006.01)

(52) U.S. Cl. ..... 30/34.2; 30/74.1; 30/77

(58) Field of Classification Search ..... 30/34.2, 30/74.1, 77, 50, 81, 59, 65, 82–84, 76
See application file for complete search history.

(56) References Cited

U.S. PATENT DOCUMENTS

| | | | | |
|---|---|---|---|---|
| 3,138,865 | A | 6/1964 | Meyer | 30/50 |
| 3,722,090 | A | 3/1973 | Dawidowicz | 30/34.2 |
| 3,724,070 | A | 4/1973 | Dorion, Jr. | 30/34.2 |
| 4,310,968 | A | 1/1982 | Buik et al. | 30/34.2 |
| 4,741,103 | A | 5/1988 | Hultman | 30/34.2 |
| 5,067,238 | A | 11/1991 | Miller et al. | 30/34.2 |
| 5,191,712 | A | 3/1993 | Crook et al. | 30/50 |
| 5,249,361 | A | 10/1993 | Apprille, Jr. et al. | 30/77 |
| 5,313,705 | A | 5/1994 | Rivers et al. | 30/34.2 |
| 5,347,716 | A | 9/1994 | Crook | 30/34.2 |
| 5,416,973 | A | 5/1995 | Brown et al. | 30/34.2 |
| 5,426,851 | A | 6/1995 | Gilder et al. | 30/50 |
| 5,526,567 | A | 6/1996 | Carson, III et al. | 30/50 |
| 5,546,660 | A | 8/1996 | Burout et al. | 30/50 |
| 5,661,907 | A | 9/1997 | Apprille, Jr. | 30/47 |
| 5,666,729 | A | 9/1997 | Ferraro | 30/50 |
| 5,689,883 | A | 11/1997 | Ortiz et al. | 30/50 |
| 5,711,076 | A | 1/1998 | Yin et al. | 30/41 |
| 5,794,343 | A | 8/1998 | Lee et al. | 30/50 |
| 5,915,791 | A | 6/1999 | Yin et al. | 30/41 |

(Continued)

FOREIGN PATENT DOCUMENTS

| | | |
|---|---|---|
| WO | WO 96/01171 | 1/1996 |

(Continued)

*Primary Examiner*—Timothy V. Eley
(74) *Attorney, Agent, or Firm*—Fish & Richardson P.C.

(57) ABSTRACT

A shaving razor blade unit that has a plurality of blades and a guard that includes two groups of rows of elongated, elastomeric fins arranged generally parallel to the cutting edges of the blades. The first group of fins has tips with generally uniform base to tip heights of a first dimension, and the second group in has tips with generally uniform base to tip heights of a second dimension, the second dimension being less than one fifth of the first dimension. Also disclosed are elastomeric guard fins having base to tip heights less than 0.15 mm, and the fins being the last skin engaging structure contacted by a user's skin before contacting the blades.

10 Claims, 2 Drawing Sheets

U.S. PATENT DOCUMENTS

| | | | | |
|---|---|---|---|---|
| 5,918,369 | A | 7/1999 | Apprille, Jr. et al. | 30/47 |
| 5,953,819 | A | 9/1999 | Simms et al. | 30/34.2 |
| 6,131,287 | A | 10/2000 | Prochaska et al. | 30/34.2 |
| 6,161,288 | A | 12/2000 | Andrews | 30/50 |
| 6,173,498 | B1 | 1/2001 | Warrick et al. | 30/50 |
| 6,182,366 | B1 | 2/2001 | Richard | 30/50 |
| 6,216,345 | B1 | 4/2001 | Andrews | 30/50 |
| 6,298,557 | B1 | 10/2001 | Gilder | 30/34.2 |
| 6,675,479 | B1 * | 1/2004 | Walker et al. | 30/34.2 |

FOREIGN PATENT DOCUMENTS

| | | |
|---|---|---|
| WO | WO 97/17174 | 5/1997 |
| WO | WO 97/25190 | 7/1997 |
| WO | WO 97/33729 | 9/1997 |
| WO | WO 99/14020-5 | 3/1999 |

* cited by examiner

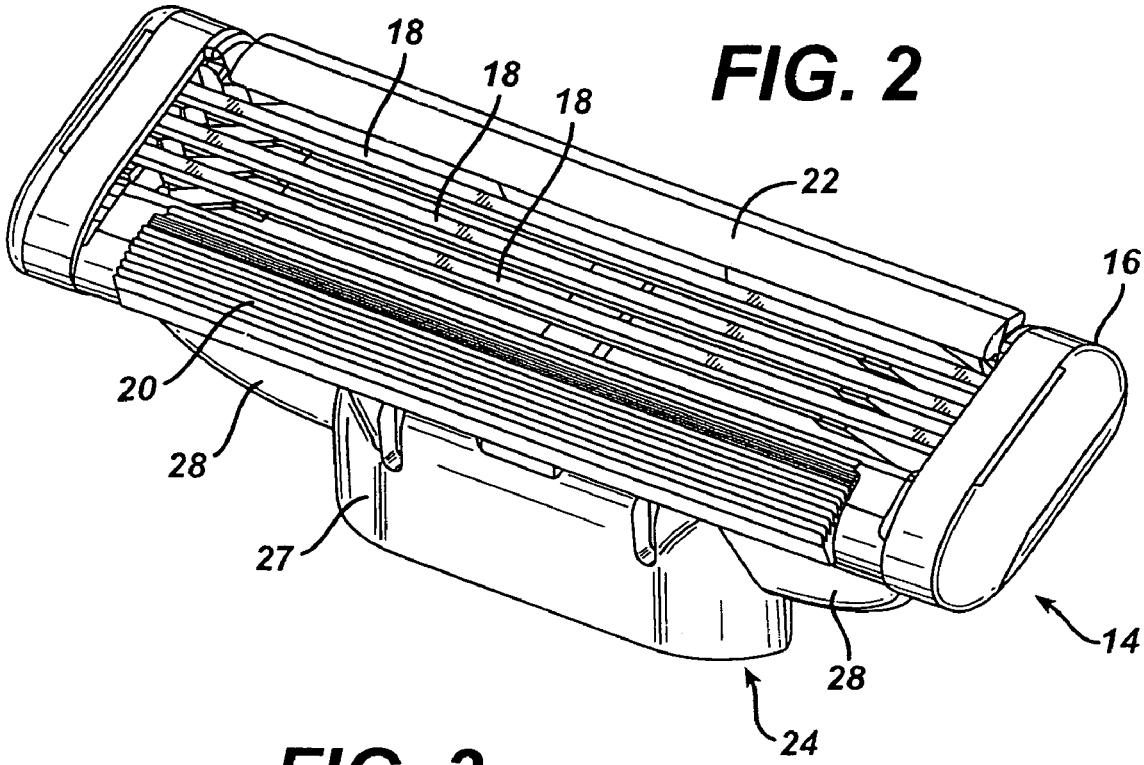
FIG. 2
FIG. 3
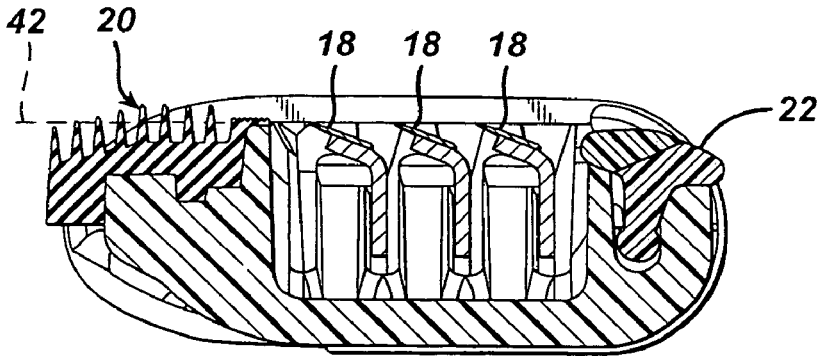
FIG. 4
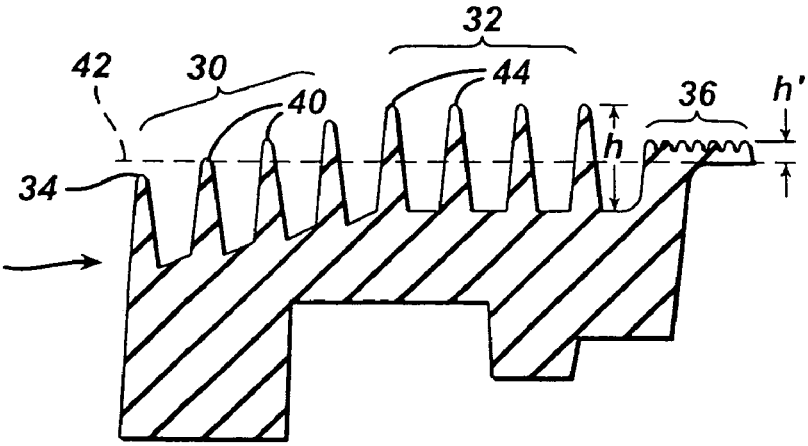

SHAVING RAZOR AND BLADE UNIT WITH IMPROVED GUARD

This is a divisional application of U.S. Ser. No. 09/515,196, filed Feb. 29, 2000 now U.S. Pat. No. 6,675,479 B1.

The invention relates to a shaving razor and a blade unit therefor with an improved guard.

Shaving razors often consist of a handle and a replaceable cartridge in which one or more blades are mounted in a plastic housing. U.S. Pat. No. 5,918,369 describes a shaving razor including a replaceable cartridge that has a blade unit that is pivotally connected to an interconnect member that is in turn connected to a handle. The blade unit includes a guard having resilient fins in front of the blades to engage the skin surface and a lubricating strip behind the blades.

SUMMARY OF THE INVENTION

In one aspect, the invention features, in general, a shaving razor blade unit that has a plurality of blades and a guard that includes two groups of rows of elongated, elastomeric fins arranged generally parallel to the cutting edges of the blades. The first group of fins has tips with generally uniform base to tip heights of a first dimension, and the second group in has tips with generally uniform base to tip heights of a second dimension, the second dimension being less than one fifth of the first dimension.

In another aspect, the invention features, in general, a shaving razor blade unit that has a plurality of blades and a guard that includes a plurality of rows of elongated, elastomeric fins arranged generally parallel to the cutting edge and having base to tip heights less than 0.15 mm.

In another aspect, the invention features, in general, a shaving razor blade unit that has a plurality of blades and a guard that includes a plurality of rows of elongated, elastomeric fins arranged generally parallel to the cutting edge, the fins being the last skin engaging structure contacted by a user's skin before contacting the blades.

Particular embodiments of the invention may include one or more of the following features. The fins in the two-group embodiments and in the embodiments where the fins are the last structure in front of the blades, the fins are small fins which also have a base to tip height of less than 0.15 mm. Preferably these small fins have a base to tip height of between 0.06 and 0.08 mm. Preferably there are at least three fins in each group.

In the two-group embodiment, some of the fins in the first group have tips above a plane passing through the cutting edges; some of the fins in a first group have some of the tips below the plane, and the second group of fins have tips above a plane. The tips in the first group of fins have a height between 0.4 mm and 0.8 mm, most preferably between 0.6 mm and 0.7 mm. They fins in a first group have an included angle less than 14 degrees most preferably about 12 degrees. The distance from the first fin of the first group to the last fin of the first group is between 2.0 mm and 3.5 mm. They first group of fins includes a leading group of fins and a trailing group of fins, the leading group having tips having increasing elevation with respect to a plane passing through the cutting edges, the trailing group having tips of generally uniform position relative to the plane.

Preferably the blades are movably mounted with respect to the housing. Preferably the blade unit is connected to a pivotal structure to permit the blades in to pivot with respect to a handle.

In another aspect, the invention features a shaving razor including a handle and a blade unit as already described connected to handle.

Embodiments of the invention may include one or more of the following advantages. The fins tend to stimulate and stretch the skin in front of the blades, tending to improve comfort and proper positioning of the skin for cutting of hairs. The fins that provide a resilient structure as the last skin contacting member before engagement by the first blade act to improve skin stretching and improve comfort. In addition, the user can adjust the geometry of the exposure of the first blade and the blade tangent angle by pressing harder on the elastomeric fins that are the last skin contacting structure before the blade. In the two group embodiments, increasing the elevation of fins tends to gradually increase skin contact and causes the tips to conform to the skin flow during shaving. The narrow included angle profile of the larger fins improves fin flexibility, which helps to stretch the skin, thereby setting up the hairs for improved cutting. The use of a large number of fins improves skin engagement.

Other advantages and features of the invention will be apparent from the following description of a preferred embodiment thereof.

BRIEF DESCRIPTION OF THE DRAWINGS

FIG. 2 is a perspective view of a replaceable cartridge of the FIG. 1 razor.

FIG. 3 is a vertical sectional view of the blade unit of the FIG. 2 replaceable cartridge.

FIG. 4 is a vertical sectional view of the guard of the FIG. 3 blade unit.

DESCRIPTION OF THE PREFERRED EMBODIMENT

Figure 1:
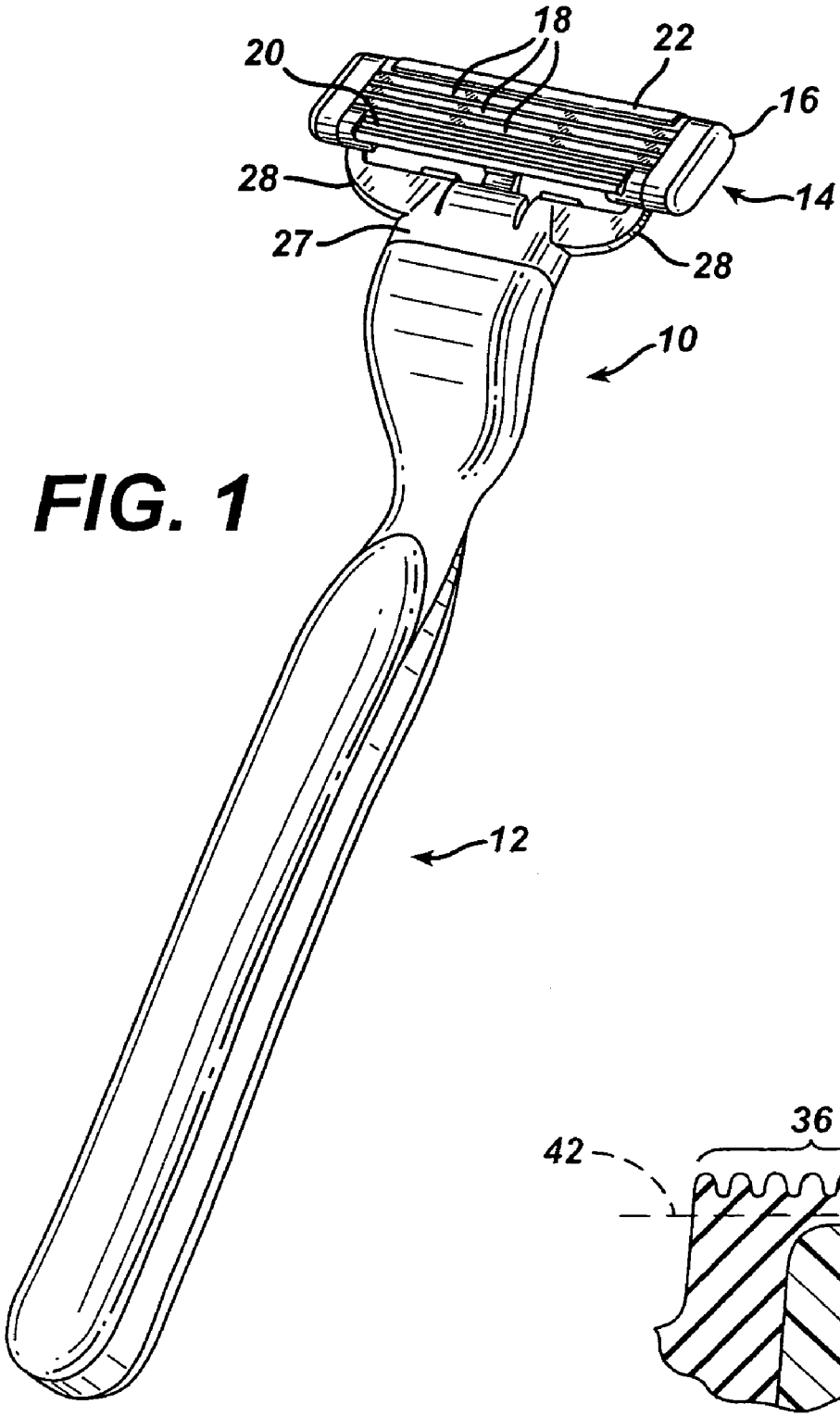
FIG. 1 is a perspective view of a shaving razor.

Referring to FIGS. 1 and 2, shaving razor 10 includes handle 12 and replaceable shaving cartridge 14. As shown in FIG. 2, cartridge 14 is removable from handle 12. Cartridge 14 includes housing 16, which carries three blades 18, guard 20 and cap 22. Cartridge 14 also includes interconnect member 24 on which housing 16 is pivotally mounted about a pivot axis. Interconnect member 24 includes a base 27 which is connected to handle 12. Base 27 has two arms 28 that pivotally support housing 16 at its two sides.

Referring to FIGS. 3 and 4, it is seen that guard 20 includes two groups 30, 32 of large fins 34 and a further group of small fins 36. Guard 20 is made of material having Shore A hardness of 30 to 60 (preferably 40 to 50, most preferably about 49). As values are increased above this range, performance may tend to deteriorate, and as values are decreased below this range, there may be production problems. Each group 30, 32 of large fins preferably includes at least three fins, most preferably about four fins. The tips 40 of the leading group of large fins 30 increase in elevation with respect to plane 42, which passes through the cutting edges of the blades 18, while the tips 44 of the trailing group of large fins 32 have a uniform elevation. A line passing through the tips 40 of the leading group of large fins 30 makes an angle of 14 degrees with plane 42. The tips 40 of the leading group of large fins 30 include some tips that are below plane 42 and some tips that are above plane 40. The tips 44 of the trailing group of large fins 32 are all above plane 40, preferably about 0.22 mm above plane 42. Fins 34 have a tip to base height "h" of 0.4 mm to 0.8 mm (more preferably between 0.6 mm and 0.7 mm, and most preferably about 0.66 mm), a base thickness of 0.15 to 0.25 mm (most preferably 0.19 mm) an included angle of less than 14 degrees, preferably about 12 degrees, and are spaced center to center by about 0.39 mm. The distance from the front of the first fin 34 to the back of the last fin 34 at the base is 2.95 mm. Alternatively; this distance can be from 2.0 mm to 3.5 mm.

Figure 5:
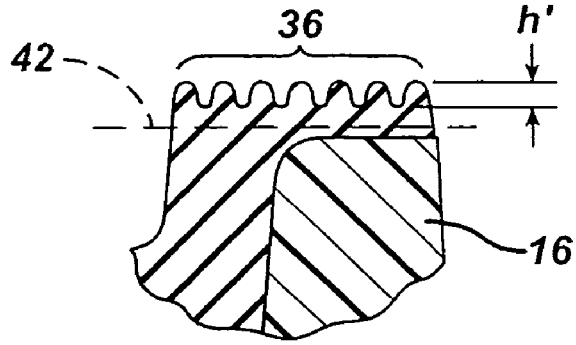
FIG. 5 is an enlarged partial vertical sectional view of small fins of the FIG. 4 guard.

Referring to FIG. 5, the group of small fins 36 have a uniform elevation with respect to plane 42. They have a height h' of less than 0.15 mm, preferably 0.06 mm to 0.08 mm (most preferably 0.065 mm), a base thickness of 0.04 mm to 0.08 mm (preferably about 0.06 mm), a tip radius of one half the base (preferably 0.03 mm) and are spaced center to center by about a distance of between 0.05 mm and 0.15 mm, most preferably about 1.0 mm. The base to tip height of the third group of small fins 36 preferably is less than ⅕ of the base to tip height of large fins 30, 32. At least part of the elastomeric portion underlining fins 36 in his preferably supported by the hard plastic of housing 16. Preferably the distance from the top of the fin to the top of the plastic housing 16 is about 0.1 mm to 0.3 mm (most preferably about 0.15 mm). The tips of fins 36 are about 0.07 mm above plane 42. Fins 36 are the last skin engaging structure contacted by a user's skin before contacting blades 18.

In use, the large fins 30 and 32 tend to stimulate and stretch the skin in front of the blades, tending to improve comfort and proper positioning of the skin for cutting of hairs. The increasing elevation of fins 30 tends to gradually increase skin contact. The uniform elevation of fins 32 provides consistent skin contact. The narrow 12 degree profile improves fin flexibility. The use of a large number of fins (e.g., greater than 6 and preferably around 8), improves skin engagement.

The small fins 36 provide a resilient structure as the last skin contacting member before engagement by the first blade, to improve skin stretching and improve comfort. In addition, the user can adjust the geometry of the exposure of the first blade and the blade tangent angle by pressing harder, thereby comprising the resilient fins.

Other advantages of the invention are within the scope of the appended claims.

The invention claimed is:

1. A blade unit of a shaving razor comprising
a housing,
a guard at the front of the housing,
a cap at the rear of the housing,
a plurality of parallel blades supported by the housing between the guard and the cap and having respective cutting edges,
said guard including a plurality of rows of elongated, elastomeric fins arranged generally parallel to said cutting edges and having base to tip heights less than 0.15 mm.

2. A shaving razor comprising a handle and a blade unit of claim 1 connected to said handle.

3. The blade unit of claim 1 wherein said fins have base to tip heights of between 0.06 and 0.08 mm.

4. The blade unit of claim 1 wherein said fins have a radius of curvature at the tips that is about one-half of the width of the fins.

5. A blade unit of a shaving razor comprising
a housing,
a guard at the front of the housing,
a cap at the rear of the housing,
a plurality of parallel blades supported by the housing between the guard and the cap and having respective cutting edges,
said guard including a plurality of rows of elongated, elastomeric fins arranged generally parallel to said cutting edges, said fins being the last skin engaging structure contacted by a user's skin before contacting said blades, at least some of said fins having base to tip heights of less than 0.15 mm.

6. A shaving razor comprising a handle and a blade unit of claim 5 connected to said handle.

7. The blade unit of claim 1 or 3 wherein there are at least three fins.

8. The blade unit of claim 1 or 5 wherein said blades are movably mounted with respect to said housing.

9. The blade unit of claim 1 or 5 wherein said blade unit is connected to a pivotal structure to permit said blades in to pivot with respect to a handle.

10. The blade unit of claim 1 or 5 wherein said fins are made of material having a Shore A hardness of between 30 and 60.

* * * * *

UNITED STATES PATENT AND TRADEMARK OFFICE

CERTIFICATE OF CORRECTION

PATENT NO. : 7,043,840 B2
APPLICATION NO. : 10/752115
DATED : May 16, 2006
INVENTOR(S) : Vincent P. Walker and Steven Metcalf It is certified that error appears in the above-identified patent and that said Letters Patent is hereby corrected as shown below:

Col. 4 In claim 7, line 35, "claim 1 or 3" should be --claim 1 or 5--.

Signed and Sealed this

Twenty-second Day of January, 2008

JON W. DUDAS
*Director of the United States Patent and Trademark Office*